United States Patent [19]

Piiroinen

[11] 4,370,875

[45] Feb. 1, 1983

[54] SLIPPING CYLINDER LOCK

[75] Inventor: Paavo Piiroinen, Joensuu, Finland

[73] Assignee: Oy Wartsila AB, Helsinki, Finland

[21] Appl. No.: 12,243

[22] Filed: Feb. 14, 1979

[30] Foreign Application Priority Data

Feb. 17, 1978 [FI] Finland ..... 780542

[51] Int. Cl.[3] ..... E05B 63/00

[52] U.S. Cl. ..... 70/422; 70/366; 70/362

[58] Field of Search ..... 70/51-52, 70/366, 377, 383, 422, 364 R, 364 A, 362

[56] References Cited

U.S. PATENT DOCUMENTS

| | | | |
|---|---|---|---|
| 2,151,245 | 3/1939 | Swilens | 70/422 |
| 3,587,261 | 6/1971 | Berry | 70/422 |
| 3,621,685 | 11/1971 | Sargent | 70/422 |

FOREIGN PATENT DOCUMENTS

| | | | |
|---|---|---|---|
| 2528712 | 1/1977 | Fed. Rep. of Germany | 70/422 |
| 1441026 | 6/1976 | United Kingdom | 70/366 |

*Primary Examiner*—Robert L. Wolfe

*Attorney, Agent, or Firm*—McAulay, Fields, Fisher, Goldstein & Nissen

[57] ABSTRACT

A cylinder lock comprising a fixed cylinder housing and therein a turnable cylinder and a lock mechanism locking the cylinder to the cylinder housing. The turning of the cylinder is performed by means of the key of the lock after the key has set the lock mechanism in a cylinder-releasing position. Force transmission from the key to the cylinder is arranged to take part, in a first stage of the function of the lock, through a slipping clutch so arranged that when the turning force of the key exceeds a certain value, the elements enclosed in the cylinder and directly connected to the key are able to slip relatively to the cylinder in the turning direction of the key, in case the key has not set the lock mechanism in its correct cylinder-releasing position.

14 Claims, 16 Drawing Figures

SLIPPING CYLINDER LOCK

Figure 1:
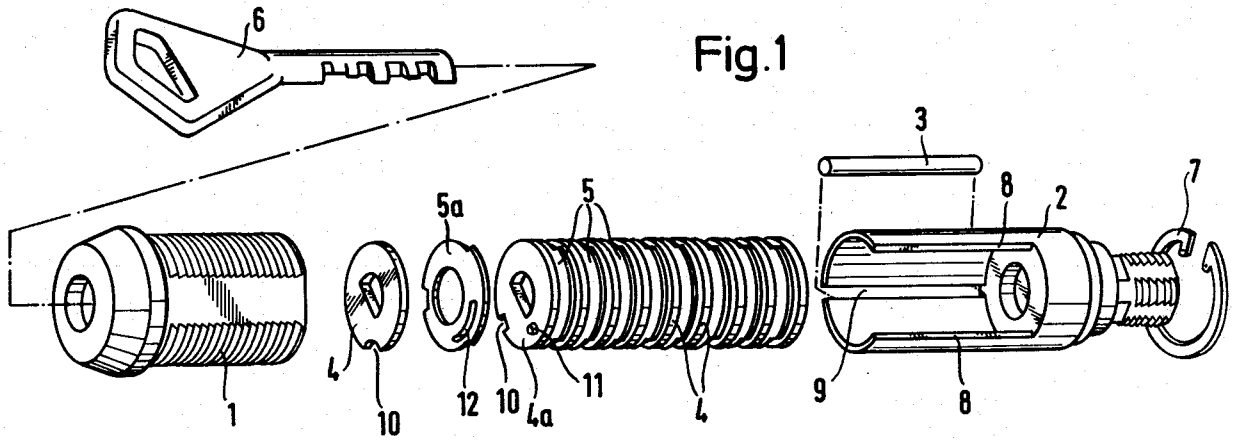

The invention relates to a cylinder lock comprising a fixed cylinder housing and therein a turnable cylinder and a lock mechanism locking the cylinder to the cylinder housing, and wherein the turning of the cylinder is performed by means of the key of the lock when the key has set the lock mechanism in a cylinder-releasing position.

Unauthorized opening of a lock can be made in principle in three different ways. One way is to attain knowledge of the lock combination and have a key produced fitting into the lock. Another way is to manipulate the lock until the locking elements have been brought to releasing position and the lock can be opened. The third way is to break the lock or its attachment. These principles can be applied to all locks. If only cylinder locks are taken into consideration and in this connection only the two last mentioned ways of action, it is evident that to a great extent a common feature is involved, that is, the loading of the lock with a turning force. Consequently, if the lock could be constructed in such a way that its loading with a turning force would be impossible, most of all known picking and breaking-up possibilities would be eliminated.

An object of the invention is to provide a cylinder lock in which the problem referred to has been solved. The invention is characterized in that force transmission from the key to the cylinder is arranged to take part in a first stage of the function of the lock through a slipping clutch so arranged, that when the turning force of the key exceeds a certain value, the elements enclosed in the cylinder and directly connected to the key are able to slip relative to the cylinder in the turning direction of the key, in case the key has not set the lock mechanism in its correct cylinder-releasing position.

In this specification and in the claims the expression "the outer end of the lock" means that end of the lock from which the key is inserted into the lock. "The inner end of the lock" means the opposite end of the lock. Logically corresponding terms are used also with respect to other parts of the lock. The word "key" may mean the normal key of the lock or a wrong key used in the lock, a picklock or the like.

In a lock according to the invention, it is important that the slipping clutch cannot slip just because the lock mechanism or the mechanisms connected thereto are hard to move, for instance, due to an outer load, ice accretion or any other corresponding reason. On the other hand, the slipping clutch should always slip in case the lock is loaded without first setting its lock mechanism in a correct cylinder-releasing position. Due to this it is of advantage to construct the lock so, that during normal function of the lock, force is transmitted from the key to the cylinder through the lock mechanism, or in other words, so that at least in that functional stage of the lock when the object is to transmit turning force from the cylinder further to a functional device connected thereto, for instance, a door lock mechanism, the lock mechanism of the cylinder lock has reached a position in which the key is mechanically locked to the cylinder so that the slipping clutch under these circumstances cannot slip in the turning direction of the key. Such a construction can usually be obtained relatively easily, but the detailed design thereof is dependent on the lock type in question.

The invention can best be applied to so called rotary disc tumbler cylinder locks, in which the lock mechanism comprises a number of tumbler discs turnable by means of the key of the lock, and between the cylinder housing and the cylinder, a locking bar movable in a radial direction of the lock, which locking bar in its locking position locks the cylinder to the cylinder housing, but which, when the tumbler discs are in an opening position determined by the lock combination, is able to move radially inwards, so that the cylinder is released from its locked position. This kind of cylinder lock is already per se very secure and its opening without the right key is practically impossible, in particular, if the lock is of first class quality. The very great security of this lock type can, by applying the invention, be brought to a still considerably higher level. In addition, just this lock type is extremely well suitable for the application of the invention, because the construction of its lock mechanism gives advantages in this respect. The function of the lock can easily be so arranged, that the locking bar of the lock, when being in its cylinder-releasing position, locks directly or indirectly the slipping clutch according to the invention so that it is unable to slip. In practice, this is carried out so that the locking bar, when being in cylinder-releasing position, locks the turning movement of all the tumbler discs of the lock with respect to the cylinder. By this means a rigid force transmitting connection between the key and the cylinder is formed, which connection by-passes the slipping clutch so that the clutch is not any more under load, and hence, cannot slip. This stage is reached when the cylinder has first been turned somewhat so that the locking bar has moved in under the cylindric internal surface of the cylinder housing, being at the same time partly in a groove formed jointly by peripheral recesses in the tumbler discs and partly in a slot in the cylinder guiding the locking bar. In this position the tumbler discs are unable to turn relative to the cylinder, and force is transmitted from the key to the cylinder through the tumbler discs and the locking bar and by-passes completely the slipping clutch which will not slip because it is not subject to any load.

When applying the invention to a rotary disc tumbler cylinder lock the slipping clutch can be composed of two disc-like clutch halves of which one is a disc rotating together with the key of the lock and the other is an adjacent disc non-turnable with respect to the cylinder of the lock. This gives a possibility to build up the slipping clutch in a very simple manner because a quite ordinary tumbler disc may function as one clutch half and as the other clutch half an intermediate disc of the kind generally used in this type of locks being non-turnable with respect to the cylinder. Said intermediate disc is usually somewhat flexible in its axial direction and due to this the whole disc set in the cylinder of the lock has some axial flexibility, which is quite sufficient for obtaining a suitably yielding slipping clutch by using relatively simple clutch surfaces. The clutch surfaces are formed by providing one disc with a small protrusion and the other disc with a recess suitably corresponding to said protrusion.

The invention can also advantageously be applied somewhat differently to a rotary disc tumbler cylinder lock, that is, so that the slipping clutch comprises as one clutch half a tumbler disc or a corresponding disc turning together with the key of the lock and as the other clutch half a suitable portion of the cylinder. A suitable portion of the cylinder may be, for instance, the bottom surface of the hollow cylinder at the inner end of the lock. Then the innermost tumbler disc or a corresponding disc may function as one clutch half. Also in this case the axial flexibility of the disc set may function as a clutch spring and suitable clutch surfaces are obtained by providing the one clutch half with a recess and the other clutch half with a corresponding protrusion.

Correspondingly, the slipping clutch can be located to the outer end of the cylinder, whereby a disc rotating together with the key may function as one clutch half and the outer end of the cylinder as the other clutch half. The slot in the cylinder keeping and guiding the locking bar is usually open at the outer end of the cylinder and this discontinuity can with advantage be used as a clutch surface. The outer clutch half should then have a protrusion fitting into said slot. A flexibility quite sufficient for the function of the clutch can be provided by the retainer ring of the cylinder which ring usually is made axially somewhat flexible as disclosed, for instance, in U.S. Pat. No. 3,199,323.

A third possibility of applying the invention to a rotary disc tumbler cylinder lock is to use as one clutch half of the slipping clutch a member rotating, at least in a certain stage, together with the key, and as the other clutch half a spring element attached to the cylinder of the lock. This solution is advantageous in such a lock where there is no axially flexible disc set, for instance, a lock of the type disclosed in U.S. Pat. No. 727,524. The member rotating together with the key may be either a normal tumbler disc, a separate disc without tumbler function or, for instance, a separate clutch member at the inner end of the lock. Irrespective of what the member rotating together with the key looks like, the common feature of all solutions of this kind is that the said member is by means of a yielding spring element connected to the cylinder of the lock. When this spring element yields said member rotating together with the key is able to rotate relative to the cylinder.

The invention can also be applied to other cylinder lock types than the rotating disc tumbler cylinder lock. The most well-known cylinder lock type is the pin tumbler cylinder lock in which the lock mechanism comprises a number of radially moving pins. To such a lock the invention is so applied that the cylinder of the lock is divided into two parts which are connected to each other by means of a slipping clutch and of which one part is mechanically connected to and rotates together with with the key of the lock, whereby, when the torque provided by the key exceeds a certain value, for instance, in case the lock mechanism is not in its cylinder-releasing position, the key and thereto attached one part of the cylinder are able to rotate freely. When the lock mechanism is in a cylinder-releasing position, the two parts of the cylinder can be rigidly connected to each other in a manner by-passing the slipping clutch by using a separate connection mechanism which performs said connection in question mechanically when activated by a small initial turning movement of the cylinder. This matter is described more in detail in connection with the description of a preferred embodiment.

Figure 2:
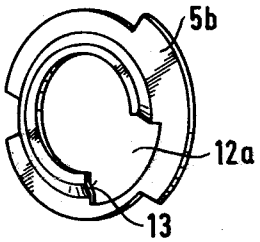
Figure 3:
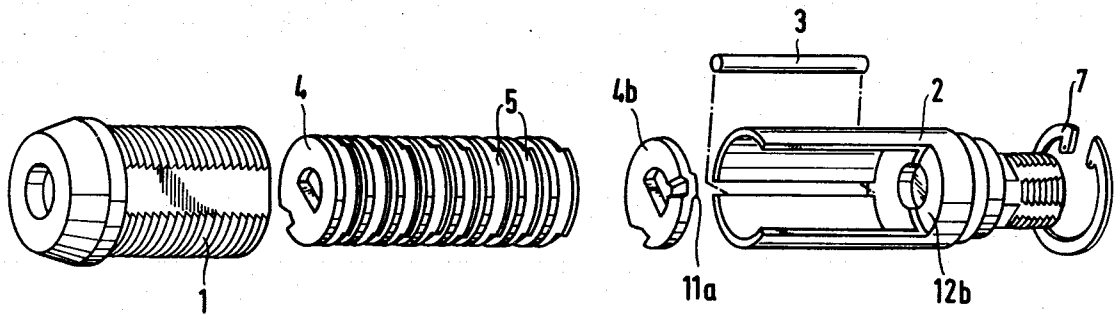
Figure 5:
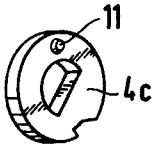
Figure 4:
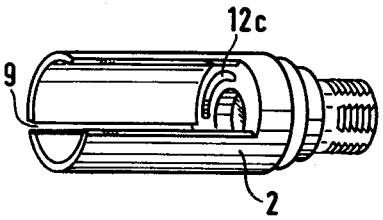
Figure 6:
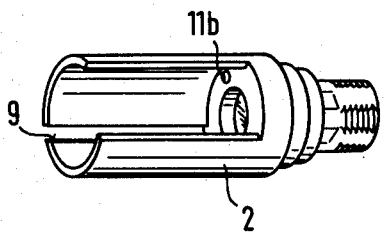
Figure 7:
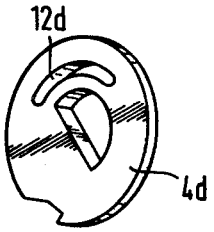
Figure 8:
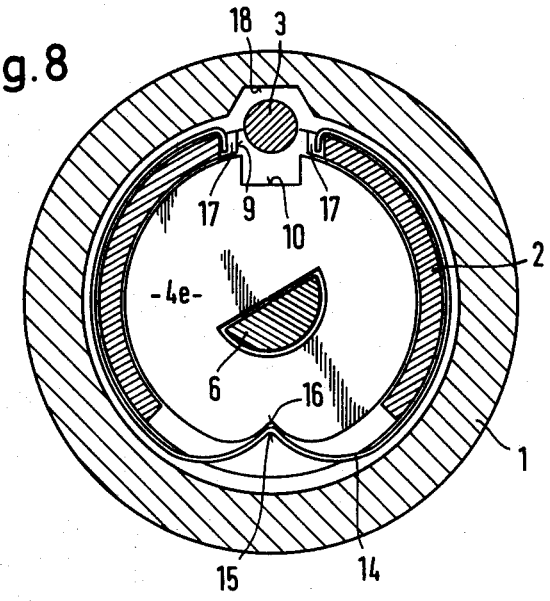
Figure 9:
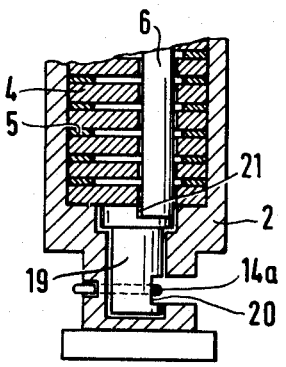
Figure 10:
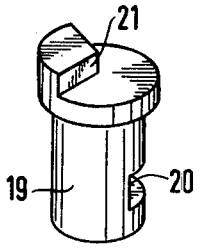
Figure 11:
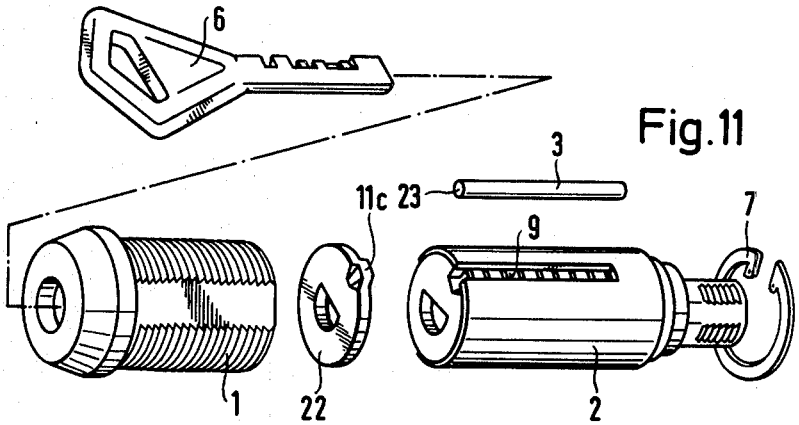
Figure 12:
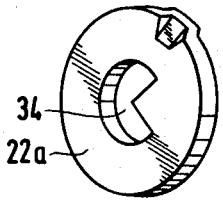
Figure 13:
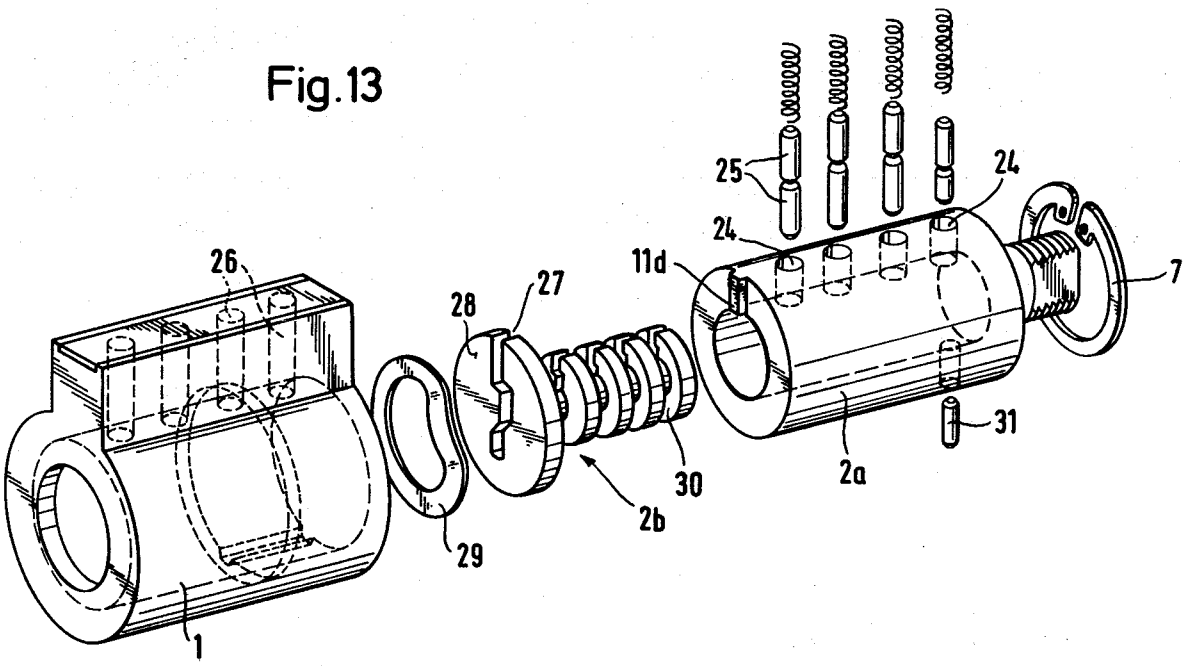
Figure 14:
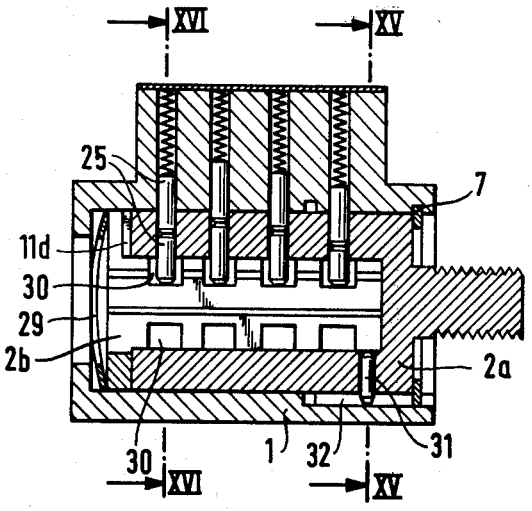
Figure 15:
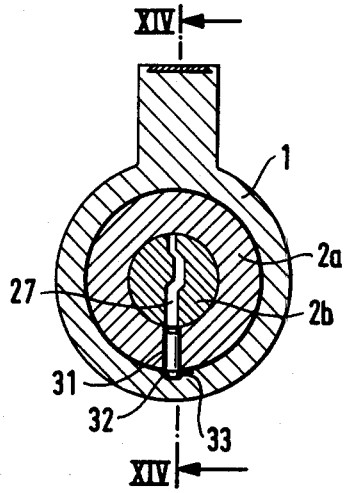
Figure 16:
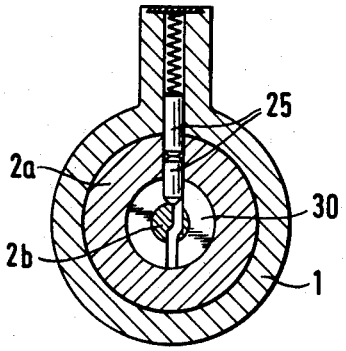

In the following, the invention will be more fully described with reference to the attached drawing, wherein FIGS. 1–7 and 10–13 are perspective views and FIGS. 1, 3, 11 and 13 are also exploded views. In the drawing, FIG. 1 shows a first embodiment of a lock according to the invention, FIG. 2 shows an alternative part suitable in a lock according to FIG. 1, FIG. 3 shows a second embodiment of a lock according to the invention, FIG. 4 shows an alternative cylinder for a lock with the same principal function as the lock shown in FIG. 3, FIG. 5 shows a tumbler disc for a cylinder according to FIG. 4, FIG. 6 shows an alternative cylinder for a lock with the same principal function as the lock shown in FIG. 3, FIG. 7 shows a tumbler disc for a cylinder according to FIG. 6, FIG. 8 shows a cross-sectional view of a third embodiment of a lock according to the invention, FIG. 9 shows in axial section the inner end of a fourth embodiment of a lock according to the invention, FIG. 10 shows a rotating clutch member of a lock according to FIG. 9, FIG. 11 shows a fifth embodiment of a lock according to the invention, FIG. 12 shows an alternative part suitable in a lock according to FIG. 11, FIG. 13 shows a pin tumbler cylinder lock according to the invention, FIG. 14 shows an axial section of a lock according to FIG. 13, FIG. 15 shows section XV—XV of FIG. 14, FIG. 16 shows section XVI—XVI of FIG. 14.

In the drawing, numeral 1 indicates the cylinder housing of a lock, 2 the turnable cylinder of the lock, 3 the locking bar of the lock, 4 tumbler discs, 5 intermediate discs, 6 the key of the lock and 7 a retainer ring for the cylinder 2. FIG. 1 shows an ordinary rotary disc tumbler cylinder lock having in its cylinder 2 a set of discs including locking discs 4 and between them intermediate discs 5. The intermediate discs are made of thin metal sheet and are so formed that they are somewhat flexible in their axial direction (FIG. 2). At the side of cylinder 2, there is an opening, of which the side edges 8 form a support for a torque of the intermediate discs 5 so that the intermediate discs cannot turn relative to cylinder 2. Diametrically opposite the just mentioned opening, there is a slot 9 for locking bar 3. When locking bar 3 is partly in slot 9 and partly in a groove 18 (FIG. 8) in the internal surface of cylinder housing 1, the turning movement of lock cylinder 2 is locked. Tumbler discs 4 are provided each with a peripheral recess 10 and the combination surfaces of key 8, which are formed by removing sector portions from one side of the semi-cylindrical shank of a key blank, turn the tumbler discs so that the peripheral recess 10 of each tumbler disc is brought to the position of locking bar 3. Thereby a joint groove is formed at the position of the locking bar and the locking bar is then able to move radially inwards into this groove, whereby it is disengaged from the grip of cylinder housing 1 so that cylinder 2 can be turned. When cylinder 2 has been turned through a small angle, locking bar 3 has been displaced to a position under the unbroken internal cylindrical surface of cylinder housing 1 and is not anymore able to move radially outwards, and locks in this position by means of the peripheral recesses 10 of the tumbler discs the turning movement of all the tumbler discs relative to cylinder 2. Hence, the whole mechanism of the lock rotates as one unit together with the key and the parts of the lock mechanism can move relatively each other only upon turning cylinder 2 back to its initial position, wherein locking bar 3 again can move radially outwards into groove 18 (FIG. 8) in the internal surface of the cylinder housing. Thereby tumbler discs 4 are again released and key 6 can be turned back to its insertion and withdrawal position.

If a wrong key, a picklock or the like is used in the lock, tumbler discs 4 will not take the correct releasing position or in other words, not all of peripheral recesses 10 are brought to the position of locking bar 3. Even if only one tumbler disc is in an incorrect position, locking bar 3 is not able to move radially inwards, and hence, cannot be disengaged from groove 18 (FIG. 8) in the internal wall of cylinder housing 1. In that case, cylinder 2 cannot be turned either. As long as locking bar 3 has not left groove 18 in the internal wall of the cylinder housing, the turning force of key 6 is transmitted to cylinder 2 only through a slipping clutch which is formed by tumbler disc 4*a* and intermediate disc 5*a*. Tumbler disc 4*a* has a small protrusion 11 which moves in a clutch groove 12 in intermediate disc 5*a* which is non-turnable with respect to the lock cylinder. At the end of this groove, a relatively weak turning force provided by key 6 can be transmitted from tumbler disc 4*a* to intermediate disc 5*a* and further therefrom over the edges 8 of the opening in cylinder 2 to the cylinder. In normal use this relatively weak turning force is completely sufficient for turning cylinder 2 so much that locking bar 3 is disengaged from the grip of cylinder housing 1 and is brought to lock the whole mechanism to a rigid turning body as has been explained above. If, however, locking bar 3 is not released from the grip of cylinder housing 1, for instance, due to the reason that in absence of the right key it has not been possible to bring all the tumbler discs to their correct cylinder releasing position, cylinder 2 cannot be turned. In this case a continued turning of the key in the same direction does not bring about any other action than that the slipping clutch slips and all the tumbler discs turn together with key 6 without allowing the locking bar to move into its cylinder releasing position, but nevertheless without causing any damage in the lock mechanism. The slipping clutch thus works as an excellent excess load safety device.

As has been explained above it is relatively important that in normal use of a rotary disc tumbler cylinder lock according to the invention the cylinder is free to turn somewhat before a great turning force is transmitted through the lock to the mechanism connected thereto, for instance, a door lock mechanism. Consequently, the connection of the cylinder lock to the mechansim driven thereby should be made so that the cylinder lock can perform a small idle movement, or clearance movement, before the actual turning force is transmitted from the cylinder lock to the mechanism in question. This, however, does not require changes in conventional lock assemblies, because a small clearance of the type referred to is already now used between a cylinder lock and the principal locking mechanism.

In FIG. 2*a* somewhat differently shaped intermediate disc 5*b* is shown, which corresponds to intermediate disc 5*a* of the lock according to FIG. 1. The only difference is that clutch groove 12 has been replaced by a clutch recess 12*a*. This recess however, functions exactly in the same way as groove 12 when it is influenced by the the protrusion 11 of tumbler disc 4*a*. The actual clutch surface is the one side edge 13 of recess 12*a*.

In a lock according to FIG. 3, the slipping clutch of the lock is at the bottom of cylinder 2, whereby the innermost tumbler disc 4*b* is provided with an axial protrusion 11*a* movable in a recess 12*b* made in the bottom of cylinder 2. Recess 12*b* can easily be made in connection with the machining of the side opening of cylinder 2. With the same milling cutter used for making said opening recess 12*b* can also be made in the same working phase. Protrusion 11*a* and recess 12*b* have exactly the same principal function as protrusion 11 and groove 12 in a lock according to FIG. 1. The axial flexibility of the disc set contained in cylinder 2 being composed of tumbler disc 4 and axially somewhat flexible intermediate discs 5 also works as a loading spring of the slipping clutch exactly in the same way as in the lock according to FIG. 1. Also in other respects the lock according to FIG. 3 works in the same way as the lock according to FIG. 1. The only difference is in the construction of the slipping clutch and in its location.

In a cylinder according to FIG. 4, recess 12*b* has been replaced by a groove recess 12*c*. The use of such a groove recess is possible provided that tumbler disc 4*c* according to FIG. 5 is used as the innermost tumbler and is provided with a small protrusion 11 which may be exactly of the same kind as protrusion 11 of tumbler disc 4*a* shown in FIG. 1. Tumbler disc 4*c* according to FIG. 5 can in principle be used also in a lock according to FIG. 3. It should be made sure, however, that the location of protrusion 11 is suitable with respect to the edge of recess 12*b*.

FIGS. 6 and 7 show a cylinder 2 and a tumbler disc 4*d*, respectively, for a lock with the same principal function as the lock according to FIG. 3, wherein the protrusion and the recess of the slipping clutch have changed places as compared to the design shown in FIGS. 4 and 5. The protrusion at the bottom of cylinder 2 is indicated by reference numeral 11*b* and the corresponding clutch groove by reference numeral 12*d*.

FIG. 8 shows a design wherein the slipping clutch is composed of a tumbler disc 4*e* and a spring element 14. Spring element 14 has a discontinuity 15 which in the design shown in the Figure consists of a bent portion, but which as well could be any suitable, preferably tooth-formed auxiliary element attached to the spring element. Correspondingly, there is in the tumbler disc 4*e* a recess 16 corresponding to discontinuity 15 of spring 14.

Spring 14 is attached to cylinder 2 in borings or recesses 17 made adjacent to locking bar slot 9. As in the embodiments shown in FIGS. 1–7, the slipping clutch according to FIG. 8 transmits turning force from key 6 in the center of the lock over tumbler disc 4*e* and spring 14 to cylinder 2. When all the tumblers discs have been brought to their correct releasing position, that is, to a position where the peripheral recess 10 of each disc is at the position of locking bar 3, the locking bar is able to move into the groove formed jointly by recesses 10 and is thereby disengaged from groove 18 of cylinder housing 1. The torque transmitted through the slipping clutch gives cylinder 2 a small initial movement due to which locking bar 3 moves away from the sector of groove 18 and is brought under the unbroken internal cylindrical surface of the cylinder housing. In this position it locks all tumblers discs 4 to cylinder 2 by means of the peripheral recess 10 of each disc, and consequently, the slipping clutch does not have to transmit any torque but the turning force is transmitted from the key directly over tumblers discs 4 and locking bar 3 to cylinder 2.

In FIGS. 9 and 10 an embodiment is shown reminiscent of the embodiment according to FIG. 8 but having the slipping clutch at the inner end of cylinder 2. A turning member 19 turned by key 6 works as one half of the slipping clutch and as the other clutch half, there is a spring element 14*a* which keeps turning member 19 in a certain position and which will not slip relative to cylinder 2 in the turning direction of the key. Spring element 14*a* is a simple flexible ring having a linear portion which is pressed against the bottom surface 20 of a segment cut out in turning member 19. The function of the slipping clutch and of the lock is principally the same as in the lock shown in FIG. 8. The difference is that turning member 19 is no tumbler disc but merely a clutch member the form of which is best shown in FIG. 10. In the embodiment shown, the force transmitting surface 21 of the turning member engaging the key is so arranged that turning member 19 starts moving only after key 6 has brought tumbler discs 4 to their cylinder-releasing position. However, it is as well feasible that turning member 19 rotates constantly together with key 6 but in that case the clutch surface must be so arranged that the slipping clutch transmits torque only when key 6 and tumbler discs 4 have reached a position in which the cylinder is released.

FIG. 11 shows a rotary disc tumbler cylinder lock according to the invention wherein the slipping clutch is at the outer end of cylinder 2. A disc 22, very much like a tumbler disc, functions as one clutch half, but it has no tumbler function, because it is fitted in the lock between the outer end of cylinder 2 and the bottom of cylinder housing 1 and is also located outside end surface 23 of locking bar 3. Disc 22 is provided with a small axial peripheral protrusion 11*c*, which fits into the outer end of slot 9 made in cylinder 2 for locking bar 3. Thus, cylinder 2 itself works directly as one clutch half. The required flexibility of the slipping clutch is provided by retainer ring 7 of the cylinder, which ring is somewhat flexible in its axial direction. The lock functions in principle in the same way as the locks shown in FIGS. 1–10. The slipping clutch transmits torque only when the peripheral protrusion 11*c* is at the end of slot 9. In other positions the clutch slips.

In FIG. 12 is shown a disc 22*a* corresponding to disc 22 of FIG. 11, which disc has a central opening 34 so formed, that there will be a force transmission from key 6 to disc 22*a* principally in the same way as the force transmission from the key to turning member 19 in the embodiment shown in FIGS. 9–10. This design gives the advantage that the key is somewhat lighter to move when setting the tumbler discs.

FIG. 13 shows a pin tumbler cylinder lock according to the invention. The cylinder of the lock is divided into two parts, and outer part 2*a* and an inner part 2*b*. In outer part 2*a* there are borings 24 for divided tumbler pins 25 of the lock. Tumbler pins 25 also move in borings 26 in cylinder housing 1. In outer part 2*a* of the cylinder there is an axial protrusion 11*d* and there is a corresponding recess in inner part 2*b* of the cylinder, which recess is a part of keyway 27. Between the end surface 28 of inner part 2*b* of the cylinder and the bottom surface of cylinder housing 1 there is an annular spring 29 which urges parts 2*a* and 2*b* of the cylinder axially against each other so that they rotate together. If, however, the torque provided by the key of the lock inserted in inner part 2*b* of the cylinder is very great, for example, in a case when tumbler pins 25 have not been brought to a position releasing the outer part 2*a* of the cylinder, spring annulus 21 yields and the clutch present between parts 2*a* and 2*b* of the cylinder slips, and the key and inner part 2*b* rotate freely without opening the cylinder lock. In order to make this possible it is necessary that tumbler pins 25 in no position are able to lock inner part 2*b* to outer part 2*a*. In the shown embodiment, this is obtained by providing inner part 2*b* with annular grooves 30 (FIGS. 14 and 15) at the positions of tumbler pins 25, so that the tumbler pins have sufficiently space for moving radially without preventing a relative turning movement between parts 2*a* and 2*b*.

In normal use of the lock it is important that the force transmission from the cylinder lock to the mechanism driven thereby is not dependent only on the torque transmitting ability of the slipping clutch. The same kind of blocking the lock mechanism is required as in a rotary disc tumbler cylinder lock so that the slipping clutch will not slip even if the torque provided by the key during normal function of the lock would be relatively great. In the shown embodiment a separate connecting pin 31 is used for solving this problem, which pin guided by oblique side surface 33 of a groove 32 in cylinder housing 1 connects parts 2*a* and 2*b* of the cylinder rigidly to each other immediately after the cylinder has made a small initial movement relatively to cylinder housing 1.

In principle, the invention can be applied also to other cylinder lock types than to rotary disc tumbler cylinder locks and pin tumbler cylinder locks. Since there is a very great number of different cylinder lock types, the application of the invention to every single lock type cannot be described in detail. From the embodiments shown it is clearly evident how the slipping clutch is arranged in a suitable place between the key and the cylinder of the lock so that the key may rotate freely if the lock mechanism has not been set to its proper opening position. By means of examples it has also been shown how they yielding properties of the slipping clutch are eliminated during normal use of the lock. From the basis of the disclosed theoretical description and the numerous application examples those skilled in the art will be able to apply the basic idea of the invention to different cylinder lock types. Hence, the invention is not limited to the examples shown, but a great number of modifications and applications are feasible within the scope of the attached claims.

I claim:

1. A cylinder lock comprising a fixed cylinder housing in which there is a turnable cylinder and locking means for locking said cylinder to said cylinder housing, and wherein turning of said cylinder is performed by means of the key of the lock upon setting said lock mechanism in a cylinder-releasing position by means of said key, said cylinder lock including means for transmitting force from said key to said cylinder, in a first stage of the function of the lock through a clutch device having a slipping function at overload so as to permit those elements of the lock mechanism being enclosed in said cylinder and being directly actuated by said key to slip relative to said cylinder in the turning direction of the key in case said key has not set said lock mechanism in said cylinder-releasing position.

2. A lock according to claim 1, including means for blocking, after an initial lock mechanism movement, the movable parts of said lock mechanism so as to form thereof a rigid member capable of transmitting turning force from said key to said cylinder and further to a functional device connected to said cylinder, said force transmission by-passing said slipping clutch device.

3. A lock according to claim 1, having a lock mechanism including a plurality of tumbler discs turnable by means of the key of the lock, and between said cylinder housing and said cylinder, a locking bar movable in a radial direction of the lock, which locking bar, in its locking position, locks said cylinder to said cylinder housing, but which, when said tumbler discs are in a cylinder-releasing position determined by the combination of said lock, is free to move radially inwards so that said cylinder is released from its locked position, said locking bar being in its cylinder-releasing position arranged to directly or indirectly block said slipping clutch device to prevent it from slipping.

4. A lock according to claim 3, in which said slipping clutch device comprises two clutch halves of which one is a tumbler disc of the lock or a corresponding disc rotating together with said key and the other half is a disc-like member adjacent to said tumbler disc or the like and non-turnable with respect to said cylinder.

5. A lock according to claim 4, in which there are, between said tumbler discs, intermediate discs, one of said intermediate discs being provided with means for functioning as one half of said slipping clutch device.

6. A lock according to claim 3, in which said slipping clutch device comprises as one clutch half a tumbler disc or a corresponding disc rotating together with said key and as the other clutch half a suitable portion of said cylinder.

7. A lock according to claim 6, in which said slipping clutch device is located to the inner end of said cylinder, where the innermost tumbler disc or a basically similar disc is provided with means for functioning as one clutch half and the bottom surface of said cylinder is provided with means for functioning as the other clutch half.

8. A lock according to claim 6, in which said slipping clutch device is located to the outer end of said cylinder and comprises a disc rotating together with said key and being provided with means for functioning as one half of said slipping clutch device and the outer end of said cylinder is provided with means for functioning as the other clutch half of said slipping clutch device.

9. A lock according to claim 3, in which a member, at least in a certain phase rotating together with said key, is provided with means for functioning as one clutch half of said slipping clutch and a spring element attached to the cylinder of the lock is arranged to function as the other clutch half of said slipping clutch device.

10. A lock according to claim 9, in which that clutch half of said slipping clutch device rotating together with said key is a tumbler disc.

11. A lock according to claim 9, in which a separate clutch member at the inner end of said cylinder is arranged to function as one clutch half of said slipping clutch device, which clutch member by means of a spring is connected to said cylinder in a manner allowing slip in the turning direction of said key.

12. A lock according to claim 1, the lock mechanism of which comprises a number of radially moving tumbler elements, such as pins, having said cylinder divided into two parts which are connected to each other over a slipping clutch device, and of which one part is mechanically connected to rotate together with said key, whereby when the torque of said key exceeds a certain value, said key and the thereto attached one part of said cylinder are able to rotate due to slip in said slipping clutch device.

13. A lock according to claim 12, in which there is a separate locking member which, guided by a small initial movement performed by said cylinder, is arranged to lock said two parts of said cylinder to each other.

14. A cylinder lock comprising a stationary cylinder housing and therein a turnable cylinder and a lock mechanism locking said cylinder to said cylinder housing, and wherein the turning of said cylinder is performed by means of the key of the lock when said key has set said lock mechanism in a cylinder-releasing position, said locking mechanism including a plurality of tumbler discs turnable by means of the key of the lock, and between said cylinder housing and said cylinder, a locking bar movable in a radial direction of the lock, which locking bar, in its locking position, locks said cylinder to said cylinder housing, but which, when said tumbler discs are in a cylinder-releasing position determined by the combination of said lock, is free to move radially inwards so that said cylinder is released from its locked position, said locking bar being in its cylinder-releasing position arranged to directly or indirectly block said slipping clutch device to prevent it from slipping, said slipping clutch device comprising two clutch halves of which one is a tumbler disc of the lock or a corresponding disc rotating together with said key and the other half is a disc-like member adjacent to said tumbler disc or the like and non-turnable with respect to said cylinder.

* * * * *